US007040266B1

(12) United States Patent
Sun et al.

(10) Patent No.: US 7,040,266 B1
(45) Date of Patent: May 9, 2006

(54) ELECTRO-HYDRAULIC ENGINE VALVE ACTUATION

(75) Inventors: Zongxuan Sun, Troy, MI (US); Rodney B. Rask, Grosse Pointe Woods, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/206,603

(22) Filed: Aug. 18, 2005

Related U.S. Application Data

(60) Provisional application No. 60/679,340, filed on May 10, 2005.

(51) Int. Cl.
*F01L 1/34* (2006.01)

(52) U.S. Cl. ..... 123/90.16; 123/90.15; 123/90.11

(58) Field of Classification Search ..... 123/90.16, 123/90.15, 90.11, 90.17, 90.31, 90.12
See application file for complete search history.

(56) References Cited

U.S. PATENT DOCUMENTS 6,739,293 B1 * 5/2004 Turner et al. ..... 123/90.12

* cited by examiner

*Primary Examiner*—Thomas Denion
*Assistant Examiner*—Zelalem Eshete
(74) *Attorney, Agent, or Firm*—Kathryn A. Marra

(57) ABSTRACT

Electro-hydraulic engine valve actuation system providing an actuator and an actuator control system. The actuator includes primary and secondary actuation chambers, defined by a piston, connected to the engine valve, and characterized by increasing and correspondingly decreasing chamber volumes, as the piston is urged away from neutral position. A fluid inlet is connected to a flow control valve. A control valve includes an actuator, and has flow states for controlling flow between two fluid inlets and a fluid outlet. The control valve includes first and second opposed, control chambers, each connected to the actuator. There is a spring in the second control chamber. The actuator of the flow control valve is controlled to a first and second state, and there is an electrically uncontrolled third flow state. There is a pair of temperature-compensated orifices which create internal feedback, with the control chambers, between the engine valve motion and the control valve position.

23 Claims, 1 Drawing Sheet

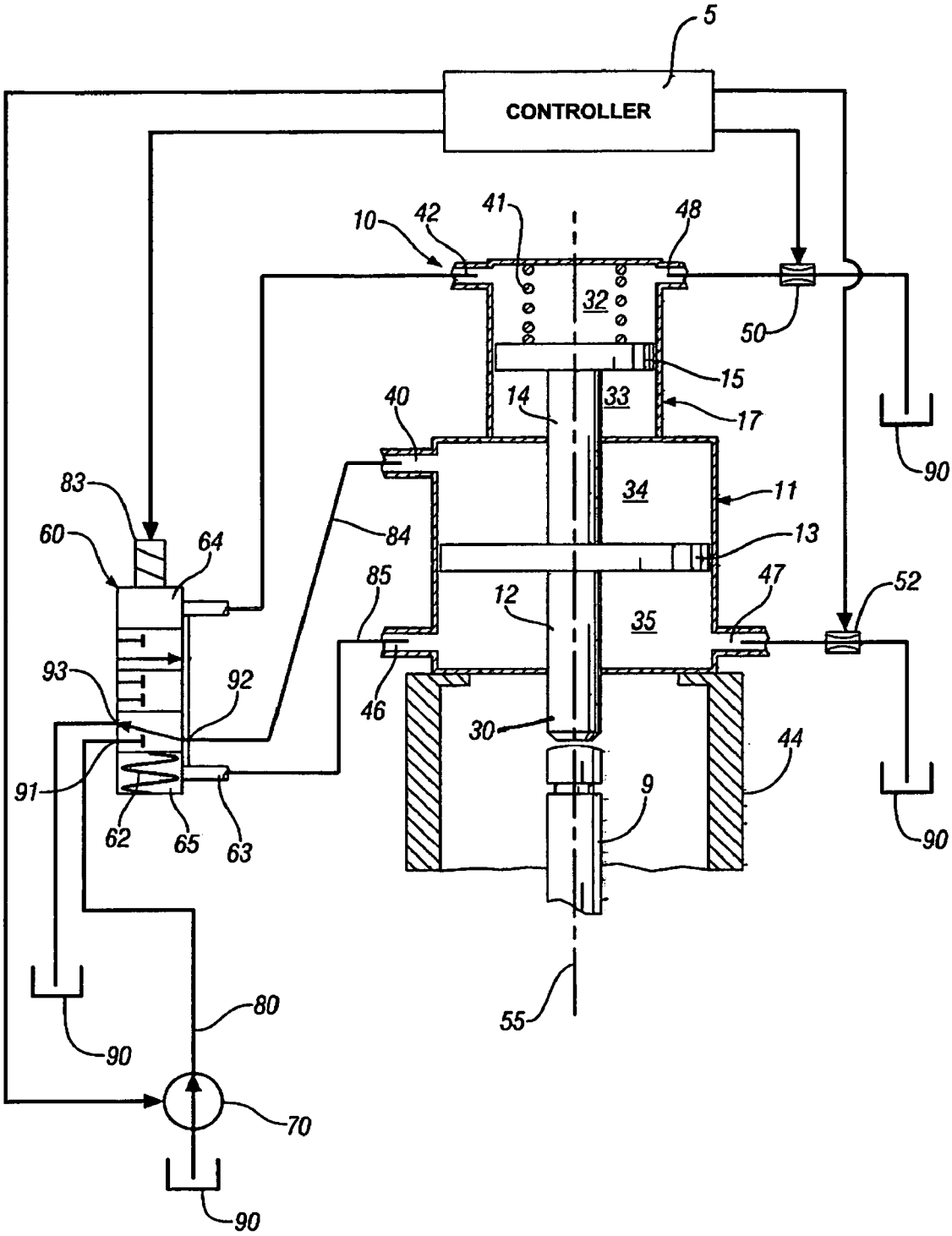
5
CONTROLLER
10
42
41
48
32
50
15
14
33
17
40
90
83
34
11
60
64
84
13
85
47
52
12
35
93
92
46
30
44
91
9
62
65
63
90
80
55
90
70
90

ELECTRO-HYDRAULIC ENGINE VALVE ACTUATION

CROSS-REFERENCE TO RELATED APPLICATIONS

This application claims priority from U.S. Provisional Application No. 60/679,340, filed May 10, 2005, entitled ELECTRO-HYDRAULIC ENGINE VALVE ACTUATION.

TECHNICAL FIELD

The present invention is related to internal combustion engine valvetrains. More particularly, the invention is concerned with engine valve actuation, especially electro-hydraulically actuated fully flexible valvetrains.

BACKGROUND OF THE INVENTION

An internal combustion engine having a fully flexible valve actuation system is desirable. The ability to control duration, phase, and lift of each engine valve provides an engine designer with tools to achieve benefits measured in emissions, engine performance and fuel economy not readily attainable with conventional valvetrains. While a certain level of flexibility is achievable with cam-based valve actuation systems, e.g., camshaft phasers, multi-profile cams and lifter deactivation, these systems are not able to provide a fully flexible valve control system having a broad range of authority to control valve opening time, duration, and magnitude of lift from fully closed to fully open.

Practitioners have investigated various systems to achieve fully-flexible valve actuation capability, including electromagnetic valve actuation systems. Such systems are camless, but have not been shown to provide variable lift control over full range of valve lift, from fully open to fully closed. Electro-hydraulic valve actuation systems have been proposed and developed for application to internal combustion engines and are capable of providing timing, phasing and fully variable valve lift. Presently known electro-hydraulic valvetrain systems are undesirably large and costly. Furthermore, energy consumption and controllability continue to present challenges to production implementation of such systems.

Therefore, there is a need for a lower cost, readily packageable, electro-hydraulic valve actuation system capable of providing full-range control of engine valve open duration, engine valve open phase relative to the crankshaft, and magnitude of engine valve lift.

SUMMARY OF THE INVENTION

The present invention improves system controllability and energy consumption. Electro-hydraulic engine valve actuation in accordance with the present invention benefits fuel and emission related objectives, performance and controllability objectives, system cost, size, packaging and operational complexity objectives.

The present invention provides an improvement over conventional engine controls by providing an actuator and an actuator control system for actuating an internal combustion engine valve. The valve actuation device includes primary and secondary fluidic actuation chambers, defined in part by an actuation piston and characterized by increasing and correspondingly decreasing chamber volumes as the actuation piston is urged away from a neutral position. There is a fluid inlet fluidly connected to a flow control valve. The actuation piston is operably attached to a plunger which actuates the engine valve. The actuator includes a fluidic actuator control chamber, defined in part by a control piston operably connected to the actuation piston, characterized by increasing chamber volume as the actuation piston is urged away from the neutral position, and having a control fluid outlet. The control valve includes a solenoid actuator, and has a plurality of flow states, for controlling flow between two fluid inlets and a fluid outlet. The control valve further includes first and second control chambers, connected to the control fluid outlet of the actuator control chamber, and to a fluid outlet of the secondary fluidic actuation chamber. There is a spring in the second control chamber. The first valve control chamber opposes the second valve control chamber. The solenoid actuator of the flow control valve is controlled to a first and second state by an electronic controller. The flow control valve also has an uncontrolled state.

Another aspect of the invention comprises each chamber of the valve actuator including a drain outlet with a temperature-compensated flow control orifice, to compensate for effects of temperature.

Another aspect of the invention comprises the actuation piston urged away from a neutral position by introduction of pressurized fluid at the fluid inlet of the actuation chamber, thus urging the engine valve open.

These and other aspects of the invention will become apparent to those skilled in the art upon reading and understanding the following detailed description of the embodiments.

BRIEF DESCRIPTION OF THE DRAWING

The invention may take physical form in certain parts and arrangement of parts, the preferred embodiment of which will be described in detail and illustrated in the accompanying drawings which form a part hereof, and wherein the FIGURE is a schematic diagram of an engine valve actuator with a hydraulic circuit, in accordance with the present invention.

DETAILED DESCRIPTION OF AN EMBODIMENT OF THE INVENTION

An exemplary engine valve actuator 10 and system is described hereinbelow, for application on with a fully flexible electro-hydraulic valve actuation system for implementation on a conventionally constructed multi-cylinder internal combustion engine. The exemplary engine typically comprises an engine block, a cylinder head 44, a crankshaft, and having a plurality of cylinders formed in the engine block. Each cylinder contains a piston operable to move linearly therewithin, and mechanically operably connected to the crankshaft via a piston rod. The crankshaft is mounted on main bearings attached to the engine block. A combustion chamber is formed in each cylinder between the top of each piston and the cylinder head. The crankshaft rotates in the main bearings, in response to linear force applied thereto by the piston rods, as a result of combustion events in each combustion chamber.

The cylinder head 44 preferably comprises a conventional cast-metal device providing mounting structure for the engine intake and exhaust valves, which is modified to effectively mount and accommodate a plurality of the valve actuators 10. There is at least one intake valve and one exhaust valve corresponding to each cylinder and combustion chamber. There is preferably one valve actuator 10 for each of the intake valves and exhaust valves. Each intake valve is operable to open and allow inflow of air and fuel to the corresponding combustion chamber. Each exhaust valve is operable to open and allow flow of products of combustion out of the corresponding combustion chamber to an exhaust system.

Referring now to the drawing, wherein the showings are for the purpose of illustrating the invention only and not for the purpose of limiting the same, the FIGURE shows a schematic diagram of an exemplary fully flexible electro-hydraulic valve actuation system, including the engine valve actuator 10, which has been constructed in accordance with an embodiment of the present invention. The exemplary system is preferably operable to control magnitude of valve lift, L, duration of valve opening, D, and timing of valve opening, θ, of each of the intake valves and exhaust valves, in response to control signals from a controller 5, according to predetermined control schemes, including compensating for effects due to variations in temperature. The controller 5 is preferably a subsystem of an overall engine control system which ongoingly controls engine operation. The engine control system monitors inputs from various engine sensors and operator interface devices (e.g. an accelerator pedal) and actuates various control devices in response thereto, using on-board control schemes in the form of algorithms and calibrations. Specifically included in the valve control scheme is an ability to monitor engine operation, operator input, and ambient conditions, and determine optimal valve opening profiles, in terms of magnitude of valve lift, L, duration of valve opening, D, and timing of valve opening, θ, relative to crankshaft angular position, to optimize engine operation.

The engine control system, including the controller 5, is preferably an electronic control module comprising a central processing unit signally electrically connected to volatile and non-volatile memory devices via data buses. The engine control system is operably attached to sensing devices and other output devices to ongoingly monitor and control engine operation. The output devices preferably include subsystems necessary for proper control and operation of the engine, including, by way of example, a fuel injection system, a spark-ignition system (when a spark-ignition engine is used), an exhaust gas recirculation system, and an evaporative control system. The engine sensing devices include devices operable to monitor engine operation, external conditions, and operator demand, and are typically signally attached to the engine control system. Control algorithms are typically executed during preset loop cycles, with each control algorithm is executed at least once each loop cycle. Loop cycles are typically executed each 3, 6, 15, 25 and 100 milliseconds during engine operation. Alternatively, control algorithms may be cyclically executed, and driven by occurrence of an event. An exemplary cyclical event comprises executing a control algorithm each engine cycle, or each engine revolution. A control algorithm for determining a position at which to control each engine valve is typically executed each engine cycle. Use of the engine control system to control operation various aspects of the internal combustion engine is well known to one skilled in the art.

Referring again to the FIGURE, the exemplary fully flexible electro-hydraulic valve actuation system consists of a high-pressure fluid control system, including a high pressure fluid pump fluidly connected to a plurality of hydraulic valve actuators, one actuator corresponding to each intake and exhaust valve in this embodiment. The exemplary schematic system shown in the FIGURE includes a single valve actuator, whereas a skilled practitioner understands that a plurality of actuators may be similarly plumbed and mechanized, such plumbing and mechanization being known to one skilled in the art or beyond the scope of the invention described herein. The controller 5 is operably connected to the high pressure hydraulic pump 70 and to an electromagnetic actuator 83 of a multi-state fluid control valve 60 associated with each actuator 10. The system includes a hydraulic fluid drain 90, and the fluid for this embodiment is preferably engine oil, although another hydraulic fluid may be preferable in an individual application. The system includes first and second temperature-compensated flow-regulating orifices 50, 52 which control flow of fluid from outlets 47 and 48 to the drain 90 from the actuator, as described hereinbelow.

Referring again to the FIGURE, a schematic diagram of valve actuator 10 is shown. Each valve actuator 10 is mounted on the cylinder head 44 in a manner suitable for a plunger 30 of the actuator 10 to physically interact with the engine valve 9. The plunger 30 and the engine valve 9 are collinear along an axis 55, in this embodiment. The actuator 10 comprises an actuation device 11 and a control device 17, operable to control position of an actuation piston 12, a control piston 14, and the plunger 30. The actuation piston 12, the control piston 14, and the plunger 30 are shown in this embodiment to be a unitary piece. It is understood that there is no requirement for an embodiment to have a unitary piece for the combination of the actuation piston 12, the control piston 14, and the plunger 30.

The actuation device 11 comprises a primary fluidic actuation chamber 34 and a secondary fluidic actuation chamber 35 having a common body separated by an actuation piston 12. The primary and secondary actuation chambers 34, 35 preferably comprise contiguous fluid chambers, formed in a cylindrically-shaped metal body, separated and defined by piston head 13 of piston 12, having a centerline collinear with the axis 55. A lower closed end of the actuation device 11, defining the secondary actuation chamber 35, includes a coaxial circular opening having an annular guide and a fluid seal (not shown), through which the plunger 30 passes. An upper closed end of the actuation device 11, defining the primary actuation chamber 34, includes a coaxial circular opening having a guide and a high pressure fluid seal through which control piston 14 passes to interact with the actuation piston 12. The primary actuation chamber 34 includes a high pressure fluid inlet 40, whereas the secondary actuation chamber 35 includes a first fluid outlet 46 and a second fluid outlet 47. The actuation piston 12 is substantially contained within the chambers 34, 35 of the actuation device 11, having piston head 13 which fits sealingly against inside walls of the actuation device 11 and forming actuation chambers 34, 35. The primary actuation chamber 34 is characterized by increasing chamber volume as the piston head 13 is urged away from neutral position by flow of pressurized fluid through the high pressure fluid inlet 40. Correspondingly, the secondary actuation chamber 35 is characterized by decreasing chamber volume as the piston head 13 is urged away from neutral position by flow of pressurized fluid through the high pressure fluid inlet 40, with fluid flowing out of secondary actuation chamber 35 through fluid outlet 46 and second fluid outlet 47 in this situation.

The control device 17 comprises a primary fluidic actuator control chamber 32 and a secondary fluidic actuator control chamber 33 separated by control piston 14. The primary control chamber 32 comprises a fluid chamber having a control fluidic outlet 42 and a drain outlet 48, and is preferably attached to the actuation device 11. The primary and secondary control chambers 32, 33 preferably comprise contiguous fluid chambers, formed in a cylindrically-shaped metal body, separated and defined by piston head 15 of piston 14, having a centerline collinear with the axis 55. A lower closed end of the control device 17, defining the secondary control chamber 33, includes a coaxial circular opening having an annular guide and a high pressure fluid seal through which control piston 14 passes to interact with the actuation piston 12. The control piston 14 is substantially contained within the control device 17, having piston head 15 which fits sealingly against the inside walls, and operable to slideably linearly move therewithin. The control chamber 32 is characterized by increasing chamber volume as the piston head 15 is urged away from neutral position by flow of pressurized fluid into the actuation chamber 34 through the high pressure fluid inlet 40, thus causing the actuation piston 12, the plunger 30, and the control piston 14 to move linearly along axis 55, thus opening the engine valve 9.

The optional first temperature-controlled orifice 50 is preferably fluidly connected between outlet 48 of the control device 17 and drain 90. The optional second temperature-controlled orifice 52 is preferably fluidly connected between outlet 47 of the actuation device 11 and drain 90. Each temperature-controlled orifice is operable to increase flow restriction, and thus reduce flow to the drain 90, with increasing fluid temperature. A skilled practitioner is able to design and implement a temperature-controlled flow restriction orifice.

The system includes electromagnetically-actuated fluid control valve 60, comprising a three-state spool fluid control valve which is electrically, operably connected to controller 5, and designed for use in a high-pressure fluid control system. The fluid control valve 60 includes two fluid inlets 91, 93 and a fluid outlet 92. The first fluid inlet 91 is fluidly connected to the high pressure flow pump 70, and the second fluid inlet 93 is fluidly connected to the drain 90. The fluid outlet 92 is fluidly connected to fluid inlet 40 of the primary fluidic actuation chamber 34. The fluid control valve 60 has first and second control chambers 64, 65, formed in the valve 60 to be operably opposed in their respective influence of position of the spool in the valve. The first fluidic valve control chamber 64 is fluidly connected to the control fluid outlet 42 of the actuator control chamber 32 and operable to urge the fluidic control valve 60 in a first direction (downward in the FIGURE) away from a third flow state, defined hereinafter, when pressurized fluid is introduced thereto. The second fluidic valve control chamber 65 is fluidly connected to the first fluid outlet 46 of the secondary fluidic actuation chamber 35, and includes a compression spring 62 further operably opposed to the first fluidic valve control chamber 64. Introduction of pressurized fluid into the second fluidic valve control chamber 65 operates to urge the fluidic control valve 60 in a second direction (upward in the FIGURE) away from a first flow state, hereinafter defined. Electromagnetic solenoid actuator 83 is operably connected to the controller 5, and is operable to move the spool of the valve 60 to control the valve either a first, a second, or a third flow state, depending upon a control signal from the controller 5.

The first flow state comprises a pressurizing or opening state. When the valve 60 is in the first state, the first fluid inlet 91, which is fluidly connected to the high pressure flow pump 70, is connected to the fluid outlet 92, which is fluidly connected to fluid inlet 40 of the primary fluidic actuation chamber 34. The second flow state comprises a pressure-hold state. When the valve 60 is in the second state, the fluid outlet 92 of the valve 60 is hydraulically sealed, and holds hydraulic pressure within the actuation chamber 34. The first fluid inlet 91 is closed, meaning the high pressure hydraulic pump 70 deadheads flow thereat. The third flow state comprises an electrically uncontrolled state, wherein position of the spool within the valve 60 is determined based upon relative hydraulic pressures in chambers 64, 65. When the valve 60 is in a neutral position, i.e. wherein the actuator 83 is de-energized, the valve is in the electrically uncontrolled third state. When the valve 60 is in the electrically uncontrolled state, and the hydraulic forces acting in chamber 64 and chamber 65 are balanced, the spring 62 keeps the spool at the third flow state. The third flow state comprises the fluid outlet 92 fluidly connected to the second fluid inlet 93 fluidly connected to the drain 90, and therefore pressure in the primary fluidic actuation chamber 34 is essentially the fluidic pressure in the drain 90.

The valve actuator 10 is physically mounted on the cylinder head at mount 44 to permit a distal end of plunger 30 of the valve actuator 10 to be in physical contact with an end of a stem of engine valve 9, and operable to exert opening force thereon. Valve 9 is preferably a conventional engine valve, configured to have a spring disposed to provide a closing force. The engine valve 9 is normally closed, and the valve actuator 10 must generate sufficient force through plunger 30 to overcome the spring closing force to open the valve 9. The engine valve 9 in a normally closed position defines a neutral position for the valve actuator 10 when assembled thereto. The hydraulic circuit described hereinabove preferably uses engine oil as hydraulic fluid, although use of other fluids is not excluded. The high pressure hydraulic pump 70 is sized to provide sufficient hydraulic pressure to overcome closing force of an engine valve spring, coupled with pumping force generated in the combustion chamber which acts upon the valve head. This is typically in the range of 7 to 21 MPa, at high engine speed conditions. A skilled practitioner is able to select components necessary to accomplish the tasks of the system described herein, including selecting a hydraulic pump having requisite pressure and flow characteristics.

Operation of the present invention is now described, by way of example, with further reference to the FIGURE, which comprises the schematic illustration of the fully flexible electro-hydraulic valve actuation system, in accordance with the present invention.

In a deactivated or neutral state, when the engine valve 9 is in neutral position, i.e. closed, the actuator 83 to flow control valve 60 is de-energized, and therefore in the second state. The process to open engine valve 9 comprises the controller 5 controlling actuator 83 to the first state, connecting valve inlet 91 with valve outlet 92, thus permitting high pressure hydraulic fluid to flow to actuation chamber 34. The pressurized fluid creates a force upon head 13 of the actuation piston 12, which propagates through plunger 30 and acts upon the stem of the engine valve 9, to exert opening force against the valve spring. When the hydraulic pump 70 exerts sufficient pressure on the actuation piston 12 to overcome closing spring force of the engine valve 9, the engine valve 9 opens. The movement of the actuation piston 12 causes a decrease in fluidic volume of secondary actuation chamber 35, with hydraulic fluid flowing through outlets 47, 46. The amount of fluid flowing through each outlet is determined by size of restriction through orifice 52, and relative pressure in chamber 65 of the valve 60. Thus an internal feedback is established between position and motion of the engine valve 9, and position of the spool of control valve 60. The movement of the actuation piston 12 further causes a corresponding movement in the control piston 14, thus increasing volume of control chamber 32, and permitting flow of fluid from chamber 64 of valve 60. The controller 5 holds valve 60 in the first state for a time-certain, until the engine valve 9 reaches the desired magnitude of lift, L. When the desired magnitude of lift, L, is reached, the controller 5 controls the valve 60 to the second state, wherein all flow through the valve 60, between inlets 91, 93 and outlet 92, is cut off. The valve 60 is controlled to the second state for a second time-certain, determined as the amount of time for the engine valve 9 to be open at the desired magnitude of lift, L. A skilled practitioner is able to determine the requisite times-certain necessary to operate in the first and second states to reach and hold the desired magnitude of lift, L. When the controller 5 determines the time-certain for keeping the engine valve 9 has expired, the actuator 83 of the valve 60 is de-energized. The force of spring 62 and hydraulic pressures in chamber 65 pushes the spool of the control valve 60 upward, away from the second flow state toward the third flow state, connecting valve outlet port 92 to inlet port 93. The high pressure fluid inside the actuation chamber 34 exhausts into the tank 90 through the control valve 60. The engine valve spring then drives the engine valve 9 upward and closed. As the engine valve 9 moves upward, the fluid inside the actuator control chamber 32 is driven out through outlets 42 and 48. A pressure inside valve chamber 64 is generated depending on the flow rate coming out of 48 and the size of orifice 50. This pressure works on the spool of the valve 60 to balance the force of spring 62. Thus an internal feedback is established between motion of the engine valve 9 and motion of the spool of valve 60. If desired, a push-pull type actuator can be used for the actuator 83 to electronically control the valve 60 to the third state.

The actuator 10 preferably includes a mechanism to provide lash adjustment, in this embodiment shown as a compression spring 41, which acts to keep the actuation piston 14 and plunger 30 physically against the engine valve stem, to accommodate dimensional changes of the valve stem caused by thermal changes in the engine and valves 9.

In an alternate embodiment, the actuator includes a position sensor (not shown) mechanized to provide engine valve 9 position feedback to the controller 5, for improved control and actuation.

The present invention provides enhanced controllability by utilizing the internal feedback mechanism between the engine valve 9 and the control valve 60. The secondary actuation chamber 35, actuator control chamber 32, the control chambers 64 and 65 and the orifices 50 and 52 are preferably sized to optimize the feedback mechanism, thus enabling better performance and less energy consumption, plus providing soft valve closing to reduce noise and wear. The present invention also employs hardware less content, which corresponds to lower cost, smaller size and less mass. The present invention relies on relatively simple external control, comprising the external flow valve 60 with the internal pressure feedback described hereinabove.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. Actuator for an internal combustion engine valve, comprising:

a) a valve actuation device, comprising:

i) a primary fluidic actuation chamber: defined in part by an actuation piston and characterized by increasing chamber volume as the actuation piston is urged away from a neutral position, and, having a fluid inlet;

ii) a secondary fluidic actuation chamber: defined in part by the actuation piston and characterized by decreasing chamber volume as the actuation piston is urged away from the neutral position, and, having a first fluid outlet and a second fluid outlet; and, iii) the actuation piston operably attached to a plunger;

b) a fluidic actuator control chamber: defined in part by a control piston operably connected to the actuation piston, and characterized by increasing chamber volume as the actuation piston is urged away from the neutral position, and, having a control fluid outlet; and, c) a fluidic control valve, having a plurality of flow states, and, having two fluid inlets and a fluid outlet, comprising:

i) a first fluidic valve control chamber, fluidly connected to the control fluid outlet of the actuator control chamber and operable to urge the fluidic control valve away from a third flow state when pressurized fluid is introduced thereto;

ii) a second fluidic valve control chamber, operably opposed to the first fluidic valve control chamber, fluidly connected to the first fluid outlet of the secondary fluidic actuation chamber, operable to urge the fluid control valve away from a first flow state when pressurized fluid is introduced thereto, and having a spring operably opposed to the first fluidic valve control chamber;

iii) the fluid outlet, fluidly connected to the fluid inlet of the primary fluidic actuation chamber; and, iv) an actuator, operable to control the fluidic control valve to one of the plurality of states.

2. The valve actuator of claim 1, comprising: the fluidic actuator control chamber having a drain outlet.

3. The valve actuator of claim 2, further comprising: the drain outlet of the fluidic actuator control chamber having a temperature-compensated flow control orifice.

4. The valve actuator of claim 3, comprising: the secondary fluidic actuation chamber having a drain outlet.

5. The valve actuator of claim 4, further comprising: the drain outlet of the secondary fluidic actuation chamber having a temperature-compensated flow control orifice.

6. The valve actuator of claim 1, wherein the plunger is operably coupled to a stem of an engine valve.

7. The valve actuator of claim 6, wherein the neutral position of the actuation piston is defined by urging of a spring operable to maintain the engine valve in a normally closed position.

8. The valve actuator of claim 7, wherein the actuation piston is urged away from the neutral position by introduction of pressurized fluid at the fluid inlet of the actuation chamber.

9. The valve actuator of claim 8, wherein the engine valve is urged open when the actuation piston is urged away from the neutral position by the introduction of pressurized fluid at the fluid inlet of the actuation chamber, thus urging the plunger against the stem of the engine valve.

10. The fluidic control valve of claim 1, further comprising: the first fluid inlet fluidly connected to a high pressure fluid source, and the second fluid inlet fluidly connected to a drain outlet.

11. The fluidic control valve of claim 10, wherein the actuator operable to control the fluidic control valve comprises an electromagnetic actuator.

12. The device of claim 11, further comprising an electronic controller operable to control the electromagnetic actuator of the fluid control valve to each of the plurality of states.

13. The fluidic control valve of claim 12, wherein the controller is operable to control the fluidic control valve to the first state, comprising: the fluid outlet of the fluidic control valve selectively fluidly connected to the first fluid inlet.

14. The fluidic control valve of claim 12, wherein the controller is operable to control the fluidic control valve to a second state, comprising: the fluid outlet of the fluidic control valve selectively fluidly sealed.

15. The fluid control valve of claim 14, further comprising the fluid inlet of the primary fluidic actuation chamber effectively fluidically sealed.

16. The fluidic control valve of claim 12, wherein the third state of the fluidic control valve comprises: the electromagnetic actuator of the fluid control valve in an electrically neutral state of control.

17. The fluidic control valve of claim 16, comprising the fluidic control valve operable to fluidly connect the fluid outlet of the fluidic control valve with the drain outlet only when fluid pressure exerted in the first fluidic valve control chamber is essentially completely balanced by fluid pressure in the second fluidic valve control chamber coupled with the mechanical force exerted by the spring.

18. Actuation system for an internal combustion engine valve, comprising:

a high pressure fluid control circuit, comprising:

1) a high pressure fluid pump fluidly connected to a plurality of valve actuators;

2) a controller, operably connected to the high pressure fluid pump and operably connected to an electromagnetic actuator of a fluidic control valve of each of the valve actuators;

3) each valve actuator comprising:

a) a valve actuation device, comprising:

i) a primary fluidic actuation chamber: defined in part by an actuation piston and characterized by increasing chamber volume as the actuation piston is urged away from a neutral position, and, having a fluid inlet;

ii) a secondary fluidic actuation chamber: defined in part by the actuation piston and characterized by decreasing chamber volume as the actuation piston is urged away from the neutral position, and, having a first fluid outlet and a second fluid outlet; and, iii) the actuation piston operably attached to a plunger;

b) a fluidic actuator control chamber: defined in part by a control piston operably connected to the actuation piston, and characterized by increasing chamber volume as the actuation piston is urged away from the neutral position, and, having a control fluid outlet; and, c) a fluidic control valve, having a plurality of flow states, and, having two fluid inlets and a fluid outlet, comprising:

i) a first fluidic valve control chamber, fluidly connected to the control fluid outlet of the actuator control chamber and operable to urge the fluidic control valve away from a third flow state when pressurized fluid is introduced thereto;

ii) a second fluidic valve control chamber, operably opposed to the first fluidic valve control chamber, fluidly connected to the first fluid outlet of the secondary fluidic actuation chamber, operable to urge the fluid control valve away from a first flow state when pressurized fluid is introduced thereto, and having a spring operably opposed to the first fluidic valve control chamber;

iii) the fluid outlet, fluidly connected to the fluid inlet of the primary fluidic actuation chamber; and, iv) an actuator, operable to control the fluidic control valve to one of the plurality of states.

19. The valve actuation system of claim 18, wherein the plunger 30 of the valve actuator is operably coupled to a stem of an engine valve.

20. The valve actuation system of claim 19, wherein the neutral position of the actuation piston is defined by urging of a spring operable to maintain the engine valve in a normally closed position.

21. The valve actuation system of claim 20, wherein the actuation piston is urged away from the neutral position by introduction of pressurized fluid at the high pressure fluid inlet.

22. The valve actuation of claim 21, wherein the engine valve is urged open when the actuation piston is urged away from the neutral position by the introduction of pressurized fluid at the high pressure fluid inlet.

23. Electro-hydraulic valve actuation mechanism for an internal combustion engine, comprising:

a valve assembly including a valve, a valve seat, a valve stem, a spring effective to urge the valve toward the valve seat, a main fluid chamber defined in part by a piston coupled to the valve stem and characterized by increasing chamber volume as the valve moves away from the valve seat, a secondary fluid chamber defined in part by the piston, characterized by increasing chamber volume as the valve moves away from the valve seat and fluidically coupled to a first low pressure fluid line, and a tertiary fluid chamber defined in part by the piston, characterized by decreasing chamber volume as the valve moves away from the valve seat and fluidically coupled to a second low pressure fluid line;

a controllable spool valve including first, second and third ports, the first, port being fluidically coupled to the main fluid chamber, the second port being fluidically coupled to a third low pressure fluid line, the third port being fluidically coupled to a high pressure fluid line, a spool having an uncontrolled position whereat the first and second ports are fluidically coupled, a first controlled position whereat the first and third ports are fluidically coupled and a second controlled position intermediate the uncontrolled and first controlled positions whereat the first port is fluidically closed;

a spring effective to urge the spool toward the uncontrolled position;

a first valve fluid chamber defined in part by the spool, characterized by increasing chamber volume as the spool moves toward the first controlled position and fluidically coupled to the secondary fluid chamber; and, a second valve fluid chamber defined in part by the spool, characterized by increasing chamber volume as the spool moves toward the third state and fluidically coupled to the tertiary fluid chamber.

* * * * *